United States Patent [19]

Vitale

[11] 4,081,877

[45] Apr. 4, 1978

[54] GUM MASSAGING IMPLEMENT

[76] Inventor: Ben Vitale, 1302 83rd St., Brooklyn, N.Y. 11228

[21] Appl. No.: 725,790

[22] Filed: Sep. 23, 1976

[51] Int. Cl.[2] ..... A46B 9/04

[52] U.S. Cl. ..... 15/188; 15/110; 15/167 R

[58] Field of Search ..... 15/186, 187, 188, 110, 15/176, 167 R

[56] References Cited

U.S. PATENT DOCUMENTS

| | | | |
|---|---|---|---|
| 88,825 | 4/1869 | Watkins | 15/188 |
| 585,385 | 6/1897 | Gould | 15/188 |
| 1,113,054 | 10/1914 | Sadler | 15/187 |
| 1,708,050 | 4/1929 | Burlew | 15/188 |
| 2,225,331 | 12/1940 | Campbell | 15/188 |

FOREIGN PATENT DOCUMENTS

| | | | |
|---|---|---|---|
| 788 of | 1861 | United Kingdom | 15/188 |

*Primary Examiner*—Peter Feldman
*Attorney, Agent, or Firm*—Alexander Mencher

[57] ABSTRACT

A gum massaging device including a handle having a toothbrush head insert retaining portion on one end thereof. The toothbrush head insert is comprised of a flexible base element, a longitudinally aligned row of vertically disposed, resilient, conically shaped massage elements affixed to the upper surface of the base element.

3 Claims, 4 Drawing Figures

GUM MASSAGING IMPLEMENT

BACKGROUND OF THE INVENTION

Various types of gum massage devices have been heretofore designed, but most of these previous gum massage devices have been of the type whereby when their use is desired as a massage device they are relatively ineffective in removing trapped food particles from between the teeth, or of the type designed primarily to remove the trapped food particles from between the teeth and having a propensity to pink the gums when their use is desired as a gum massage device. Previously patented examples of the former design are disclosed in U.S. Pat. Nos. 2,476,201, 3,050,072, 3,753,266, and previously patented examples of the latter are disclosed in U.S. Pat. Nos. 2,154,846, 3,359,588, and 3,553,759.

SUMMARY OF THE INVENTION

The gum massage device of the instant invention includes a handle having a toothbrush head insert retaining portion on one end thereof. The toothbrush head insert is comprised of a flexible base element, a longitudinally aligned row of vertically disposed, resilient, conically shaped message elements affixed to the upper surface of the base element.

The main object of this invention is to provide a gum massage device constructed in a manner whereby the conically shaped massage elements have a coefficient of elasticity sufficiently low to provide utility in removing trapped food particles from between the teeth, yet when a lateral massaging motion is imparted to the device the massage elements communicate with the base element in a manner whereby the gums are stimulated and massaged with little danger of pinking.

Another object of this invention is to provide a gum massage device constructed in a manner whereby the device may be used to stimulate and massage the gums of denture wearers.

A final object of this invention to be specifically enumerated herein is to provide a gum massage device in accordance with the preceding objects and which will conform to conventional forms of manufacture, be of simple construction and easy to apply to the teeth and gums so as to provide a device that will be economically feasible, long lasting and relatively trouble free in use.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
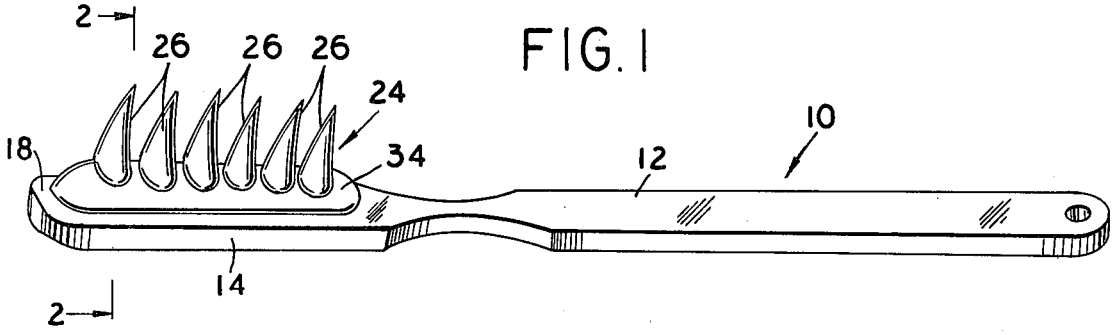
FIG. 1 is a perspective view of the gum massage device constructed in accordance with the present invention.
Figure 2:
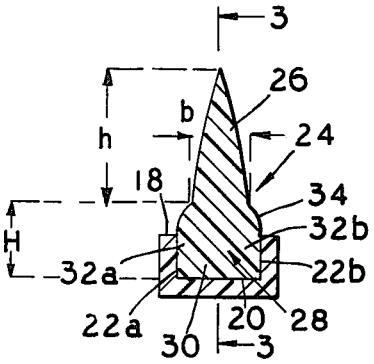
FIG. 2 is a cross sectional end view taken substantially upon a plane indicated by the section line 2 — 2 of FIG. 1.
Figure 3:
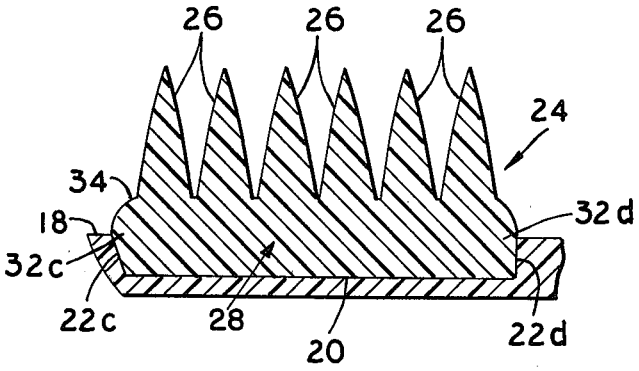
FIG. 3 is a fragmentary cross sectional side view taken substantially upon a plane indicated by the section line 3 — 3 of FIG. 2.

Referring now more specifically to the drawings, the numeral 10 generally designates a conventional form of toothbrush handle including a tapered neck 12 and a head member 14. A recess is provided in the upper surface 18 of head element 14 wherein the recess is bounded by a bottom surface 20 and four upwardly extending side walls 22*a, b, c,* and *d.*

A massage element insert generally designated by the reference numeral 24 is provided for affixation within the aforementioned recess in upper surface 18. The massage element insert 24 includes a longitudinally aligned row of a plurality of flexible, resilient, vertically disposed, conically shaped massage elements 26, wherein each element 26 is defined by a base dimension "*b*" and a height dimension "*h.*" Massage element insert 24 is further provided with a flexible, resilient base element 28 including a bottom surface 30, four sides 32*a, b, c,* and *d* of height "H" and a rounded upper surface 34 to which the base of the massage elements 26 are affixed.

In the preferred embodiment the massage elements 26 are constructed of a homogeneous material, and dimensionally, the height "H" of base element 28 is of a magnitude at least one-half that of the height "*h*" of each of the plurality of conically shaped massage elements 26, and the base dimension "*b*" has a magnitude preferrably greater than one-third that of the height "*h.*"

The theory behind the above disclosed dimensional configuration is discussed below.

It is desirable for the gum massage device to serve two purposes, as noted earlier, to clean trapped matter from between the teeth and to provide for stimulating but painless massage of the gums. In order to provide the massage elements 26 with a degree of resistance against buckling under the normal force necessary for effective cleaning action between the teeth and yet, under lateral force, allow for a stimulating massage of the gums it has been found desirable that the base element 28 should have a coefficient of elasticity as high as that of the massage elements 26. It has additionally been found desirable that the dimensional configuration be as disclosed earlier in the description.

Figure 4:
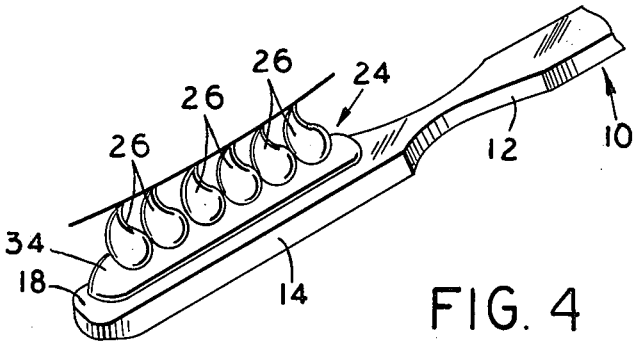
FIG. 4 is a perspective view of the gum massage device in operation.

When the preceding dimensional configuration and proper resilient, flexible material (preferably latex or closed cell rubber foam) is supplied, the gum massage elements 26 have the necessary resistance to buckling upon application of a downwardly directed normal force sufficient to dislodge trapped food particles and still be subject to sufficient lateral deflection, (See FIG. 4), to provide stimulating gum massage with a minimum danger of pinking the gum.

I claim:

1. A gum massaging device including a handle having a toothbrush head insert retaining portion on one end thereof in the form of a recess wherein said recess is bounded by a bottom surface and four upwardly extending side walls, said toothbrush head insert comprising:

(a) a flexible resilient base element affixed within said recess, said base element including a bottom surface, four sides of a predetermined depth, and a rounded upper surface;

(b) a single longitudinally aligned row of vertically disposed, similarly flexible, resilient conically shaped massage elements affixed to the said rounded upper surface of said base element along the central longitudinal axis and inwardly of the longitudinal sides of said base element, wherein each of said conically shaped massage elements include a base and a height dimension wherein said base dimension is about one-third the magnitude of said height dimension; and (c) a relationship between the height of said base element and the height dimension of each of said conically shaped massage elements wherein said height of said base element has a magnitude of about one-half of said height dimension said head insert being integrally formed.

2. A gum massaging device according to claim 1 wherein said toothbrush head insert is constructed of a homogeneous, flexible, resilient material.

3. A gum massaging device according to claim 2 wherein said toothbrush head insert is constructed of latex.

* * * * *